US007048526B2

(12) United States Patent
Patterson

(10) Patent No.: US 7,048,526 B2
(45) Date of Patent: May 23, 2006

(54) SHARED SLOT VANE PUMP

(75) Inventor: Albert W. Patterson, West Lorne (CA)

(73) Assignee: 1564330 Ontario Inc., Seaforth (CA)

( * ) Notice: Subject to any disclaimer, the term of this patent is extended or adjusted under 35 U.S.C. 154(b) by 195 days.

(21) Appl. No.: 10/845,073

(22) Filed: May 14, 2004

(65) Prior Publication Data

US 2005/0254984 A1 Nov. 17, 2005

(51) Int. Cl.
*F03C 2/00* (2006.01)

(52) U.S. Cl. ..... 418/255; 418/146; 418/159; 418/254

(58) Field of Classification Search ..... 418/255, 418/254, 266–268, 159, 140, 145, 146, 156
See application file for complete search history.

(56) References Cited

U.S. PATENT DOCUMENTS 68,186 A * 8/1867 Hall ..... 418/255
1,066,506 A * 7/1913 Krogel ..... 418/255
1,972,744 A * 9/1934 Lister ..... 418/255
4,432,711 A * 2/1984 Tsuchiya et al. ..... 418/255
4,561,834 A * 12/1985 Poss ..... 418/255
6,554,596 B1 4/2003 Patterson
6,896,502 B1 * 5/2005 Patterson ..... 418/159

* cited by examiner

*Primary Examiner*—Theresa Trieu
(74) *Attorney, Agent, or Firm*—Nixon Peabody LLP; Jeffrey L. Costellia

(57) ABSTRACT

A rotary piston pump comprising a rotor mounted within a housing, the rotor having a pair of slidably mounted vanes on opposite surfaces. The inner wall of the housing acts as a cam surface to move the vanes inwardly, and centrifugal force or a combination of centrifugal force and biasing causes the vanes to move outwardly. The rotor is eccentrically mounted within the housing and the housing interior walls are of irregular configuration, whereby fluid from an inlet is moved by the vanes through the housing to an outlet. This rotary piston pump is of economic construction, serves a variety of applications and is easy to service.

8 Claims, 4 Drawing Sheets

SHARED SLOT VANE PUMP

FIELD OF THE INVENTION

The present invention relates to a novel construction of positive displacement pump for fluids, and more particularly to a rotary piston pump.

BACKGROUND OF THE INVENTION

Rotary pistons, in the nature of encased rotors with radially extending vanes which move in and out of the rotors, depending upon their location within the casing used, for example, as pumps or turbines, are known. One such device is described in U.S. Pat. No. 6,554,596 of Albert and David Patterson issued Apr. 29, 2003, in which the vane movement, in and out of the rotor, is achieved by cam surfaces within the casing which act on both inner and outer edges of the vanes.

In my co-pending U.S. patent application Ser. No. 10/680,236 entitled "Rotary Pistons", the outward movement of the vanes is achieved by upward extensions of shoulders at the sides of each vane, which upward extensions contain pins which are seated in races continuously extending in portions of the interior wall of the casing and positioned so that as the pins move about the races, they draw their respective vanes outwardly.

Other known constructions of such vane pumps require centrifugal force, through rotation of the rotor, to force the vanes out.

Problems with such arrangements, if applied to pumps, include leakage of fluid between the vanes and consequent inability to effectively and efficiently handle fluids under high pressure. Of necessity, such devices have conventionally been of relatively small size, and, while they have been able to operate at fast speeds, they have been able to move only relatively low volumes of fluid.

Traditionally, positive displacement pumps have been of relatively complex construction and have been limited in their applications.

It is an object of the present invention to provide a positive displacement pump which is relatively economical to construct and efficient in its operation, which will be able to withstand high pressures and which will have a variety of applications.

SUMMARY OF THE INVENTION

In accordance with the present invention there is provided a positive displacement pump for fluids which pump comprises a housing defining a chamber having opposed, interior end walls and an interior side wall. A fluid inlet port and a fluid outlet port are located at spaced locations in the interior side wall. A rotor to rotate about a longitudinal axis extending through the end walls is mounted within the housing chamber, the rotor having ends and a cylindrical side wall confronting respectively the interior end walls and side wall of the chamber. A rotor disk is provided at each end of the rotor secured to the rotor, the diameter of the rotor disks being greater than the diameter of the rotor. A slot extends diametrically completely through the rotor, longitudinally between the rotor ends. The slot has openings in opposite portions of the rotor side wall.

A pair of similar, planar vanes are provided, one vane slidably mounted in one opening of this slot and the other mounted in the other opening of the slot. Each vane extends from end to end in the rotor and has inner and outer edges extending parallel to the axis rotation of the rotor. Each vane is mounted so as to slide within the slot between an extended position protruding upwardly from a surface of the rotor side wall and a retracted position wherein the vane is entirely withdrawn into the rotor below that surface. Each vane is provided with opposite shoulders at their sides, which shoulders slide in corresponding slots in the rotor disks.

A first portion of the interior side wall of the housing is cylindrical and curved with constant radius over an angle of approximately 180°. This portion is spaced a constant distance from corresponding portions of the side wall of the rotor. A second portion of the interior side wall of the housing, in the vicinity of the outlet port, extends from an extremity of the first portion so as to be progressively closer to the rotor side wall until it is immediately adjacent to that side wall at a point beyond the outlet port intermediate between the outlet port and inlet port. A third portion of the interior side wall of the housing, in the vicinity of the inlet port, extends from the midpoint to the other extremity of the first portion of the interior end wall. The distance between the third portion and the side wall of the rotor progressively increases between the midpoint and the other extremity of the first portion.

The rotor, housing and vanes are constructed so that, during operation of the pump, fluid entering the housing through the inlet port is carried by the rotor in compartments formed between adjacent vanes, the rotor side wall between those vanes, the rotor disks and the interior side wall of the housing, until the compartments communicate with the outlet port, whereby the fluid is moved from the chamber through the outlet port. The vanes, during this operation, are urged outwardly so that their outer edges are in constant contact with the interior side wall of the housing and being urged inwardly by the housing side wall acting as a cam surface on said outer edges.

In a preferred embodiment of the present invention, the outer edges of the vanes are enlarged to form heads which provide additional weight to the vanes. The vanes' outward movement is caused by centrifugal force during operation of the pump. The opening of the slot, on each side of the rotor, is enlarged to receive the enlarged head of the corresponding vane when the vane is in retracted position.

In another embodiment, biasing means are provided between the inner edges of the vanes within the vane slot to provide outward biasing of the vanes during operation of the device and to ensure constant contact of the outer edges of the vanes with the inner side wall of the housing.

The pump according to the present invention, while providing many of the same advantages of applicant's previously developed rotary pistons, is simpler and more economical to construct, since the extending vane movement does not require end cams or races to activate and guide that movement. The present invention has a wide range of applications including pumping waste water or well water, and as a hydraulic pump.

BRIEF DESCRIPTION OF THE DRAWINGS

These and other advantages of the invention will become apparent upon reading the following detailed description and upon referring to the drawings in which.

Figure 1A:
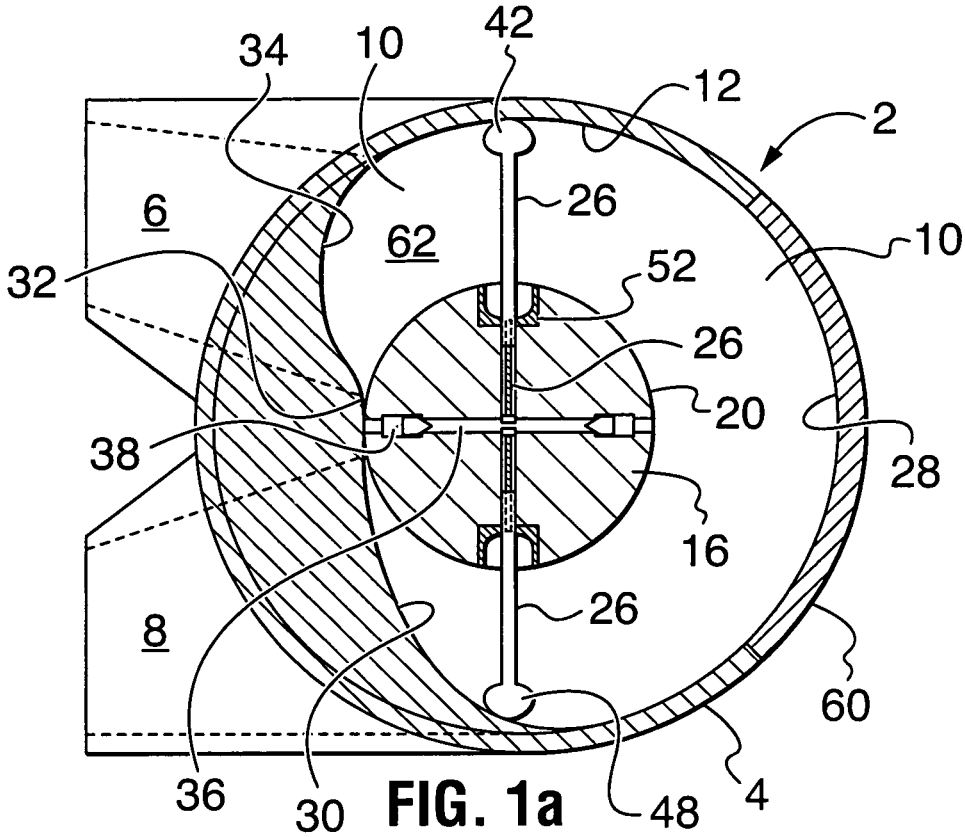
FIGS. 1*a*, 1*b* and 1*c* are schematic side section views of an example embodiment of a positive displacement rotary piston pump according to the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Figure 1B:
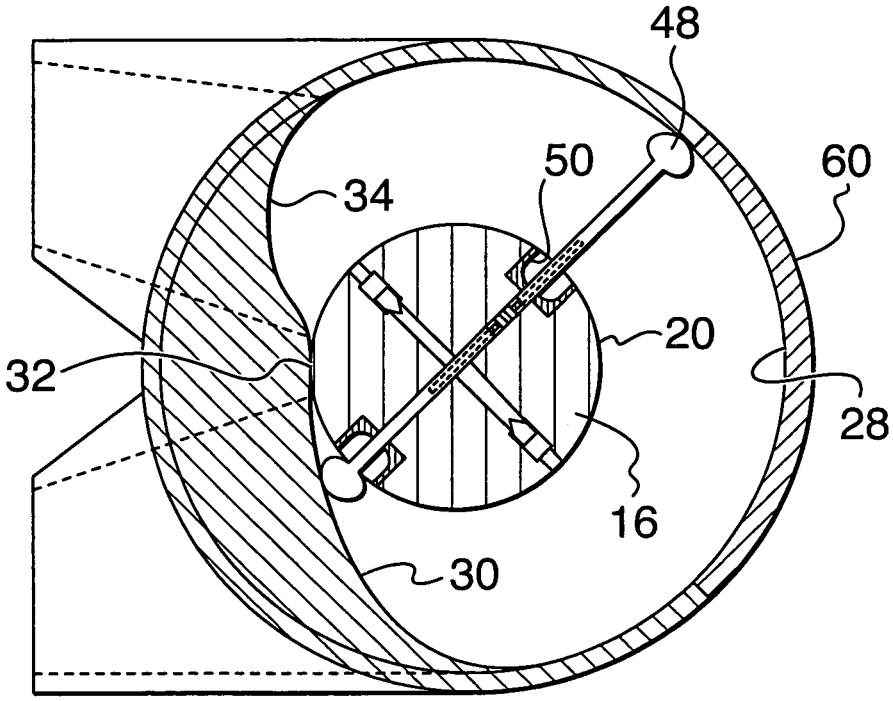
Figure 1C:
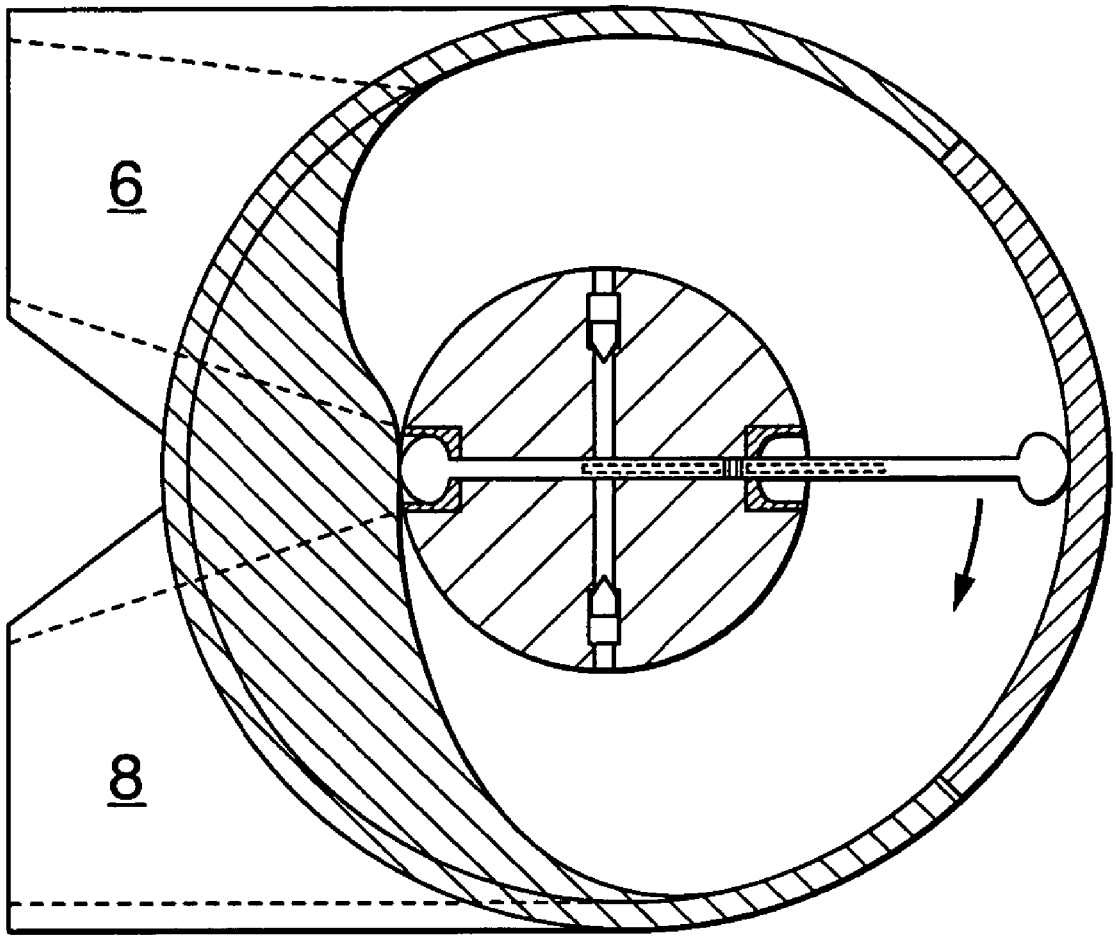
Figure 2:
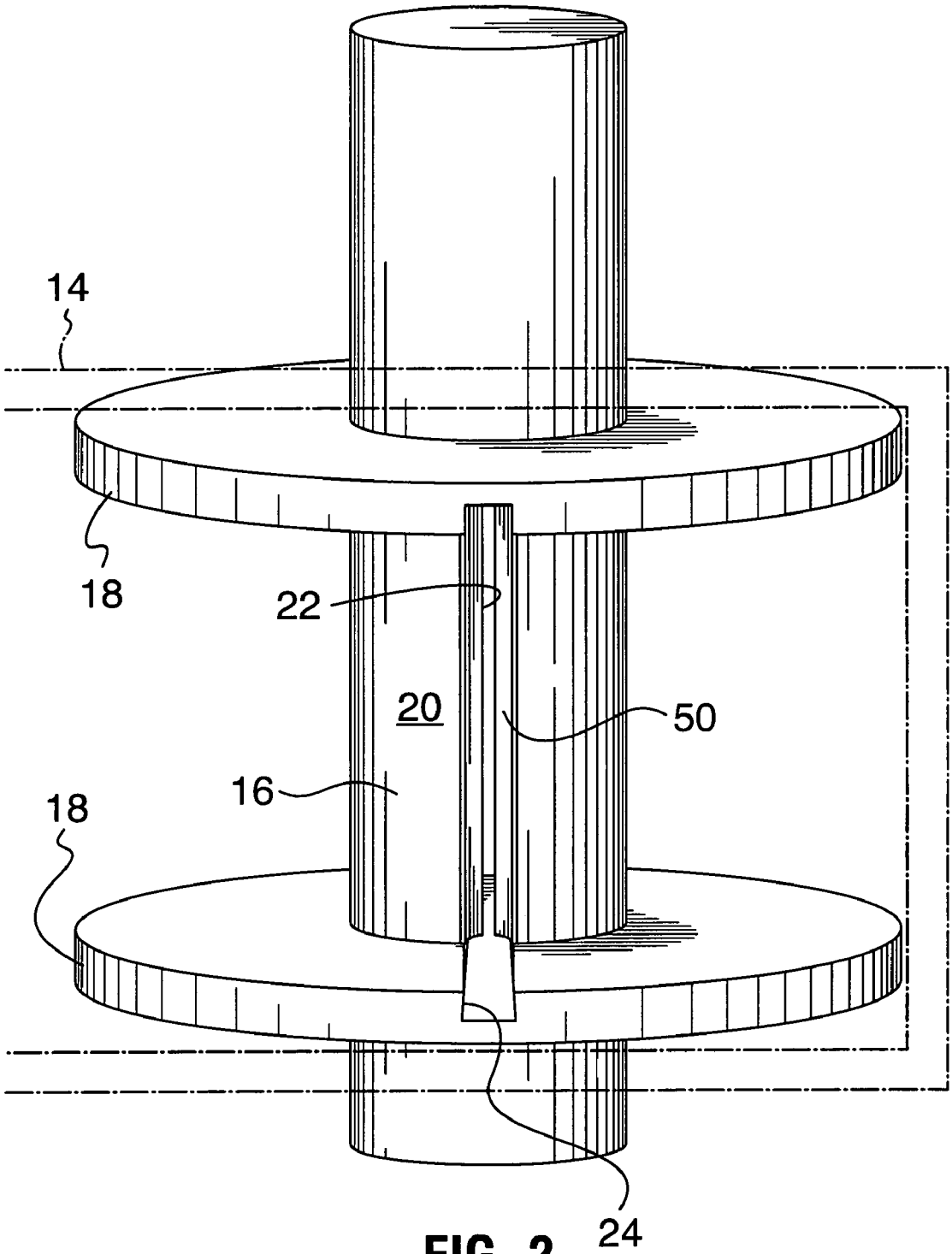
FIG. 2 is a perspective view of the rotor and end disk construction of the pump according to FIG. 1.

Turning to FIGS. 1*a*, 1*b*, 1*c*, there is illustrated a pump 2 in accordance with the present invention, at sequential stages of its operation. Pump 2 has a housing 4 with an inlet port 6 and outlet port 8 spaced to one side of it and communicating with an interior chamber 10 defined by a side wall 12 extending between opposite end walls 14. Mounted within housing 4, for rotation about a longitudinal axis extending between end walls 14 (phantom, FIG. 2) is a rotor 16 and associated end disks 18. End disks 18 may be secured to rotor 16 or may be integral therewith. The diameters of end disks 18, as can be seen, are greater than the diameter of rotor 16. Rotor 16 has a side wall 20 of elongated, cylindrical configuration. Diametrically positioned within rotor 16 is a vane slot 22 which passes through rotor 16 and extends from end to end. Corresponding slots 24 are provided in end disks 18, aligned with vane slot 22 and extending beyond that slot, as illustrated. Mounted within vane slot 22, for cooperative sliding movement on opposite sides of rotor 16, is a pair of vanes 26.

Interior side wall 12 of housing 4, as can be seen in FIGS. 1*a*, 1*b* and 1*c* is carefully configured so as to act as a cam surface guiding vanes 26, for proper operation of pump 2. In particular, a cylindrical first portion 28 of side wall 12, over about 180°, is provided. Rotor 16 is positioned within interior chamber 10 so that the surface of its side wall 20 is the same distance from this first portion 28 of housing interior side wall 12. A second portion 30 of interior side wall 12 extends from one extremity of first portion 28 to a midpoint 32 between inlet and outlet port 6 and 8, this portion being contoured so that its surface progressively approaches the surface of side wall 20 of rotor 16 until, at midpoint 32, those two surfaces are contiguous or immediately adjacent to each other. This second portion 30 extends across outlet port 8.

A third portion 34 of interior side wall 12 extends from this midpoint 32 to the other extremity of first portion 28 in a manner such that the distance between third portion 34 and corresponding portions of the rotor surface progressively increase. Portion 34 extends across inlet port 6.

The rate at which this distance to the surface of rotor 16 progressively increases and decreases for portions 30 and 34 may be adjusted for specific applications and desired efficiencies of the pump.

Passing through rotor 16, preferably at a 90° angle to vane slot 22, are one or more vent slots 36, communicating with the interior chamber 10 of housing 4 and with vane slot 22. A pair check valves 38 are provided in vent slot 36 as illustrated, to enable one way passage of fluid, outwardly, from vent slot 36, to the surface of rotor 16.

Vanes 26 have a planar body 40, upper edges 42 and lower edges 44. The height of the vanes, between upper and lower edges 42 and 44, is such that, during operation of the pump, the movement of one vane does not obstruct the movement of the other. Vanes 22 extend from end to end of rotor 16, and beyond with their shoulders 46 slidably received in end disk slots 24. Vanes 26 slide within vane slot 22 between retracted and extended positions, upper edges 42 being at all times in contact with side wall 12. Each of the vanes 22 is provided with enlarged head 48, the surface of which is rounded to conform with the cylindrical surface of side wall 12 of rotor 16 when the vane is in retracted position. A suitable cavity 50 is provided at each entrance to vane slot 22, as illustrated, to flushly receive head 48 when vane 26 is in retracted position. It is preferred that a resilient seat 52 be provided over the sides of cavity 50, so as to provide a sealing function to reduce the amount of fluid which would enter vane slot 22 from contacting surfaces of vane 26, and to act as a shock absorber to cushion the impact of head 48 against rotor 16 as vane 26 reaches its retracted position. The enlarged head 48 of vanes 26 provides additional weight to ensure that centrifugal force, as rotor 16 rotates during operation of the device, keeps the upper edge 42 of each vane 26 bearing against side wall 12 of housing 4.

Figure 3:
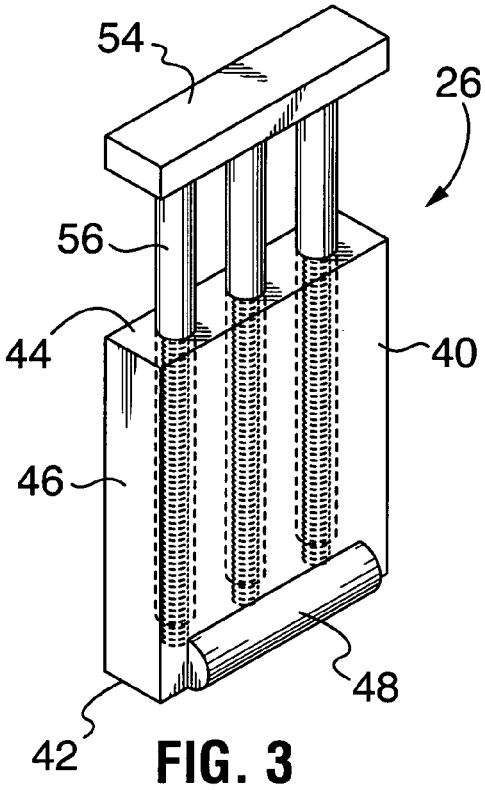
FIGS. 3 and 4 are perspective views of example embodiments of vanes usable in association with the rotor and end disk, in accordance with the present invention.
Figure 4:
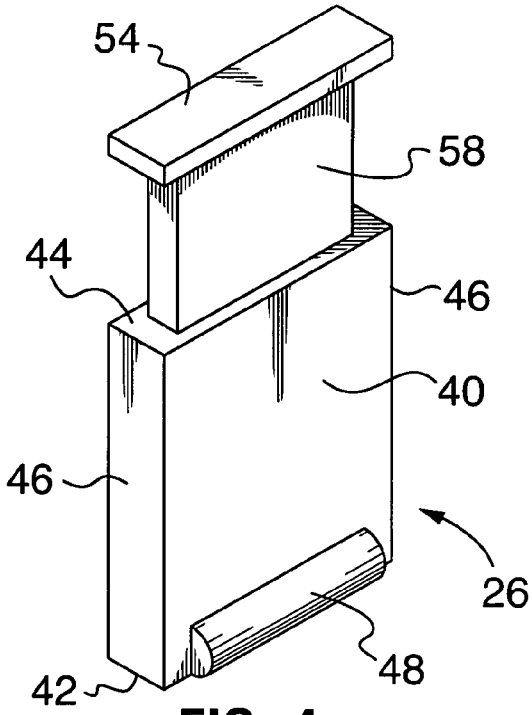
Figure 5:
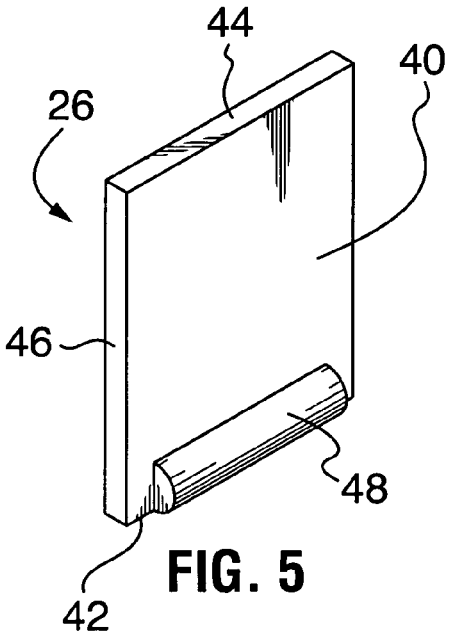
FIG. 5 is a perspective view of a further embodiment of vane in accordance with the present invention.
Figure 6:
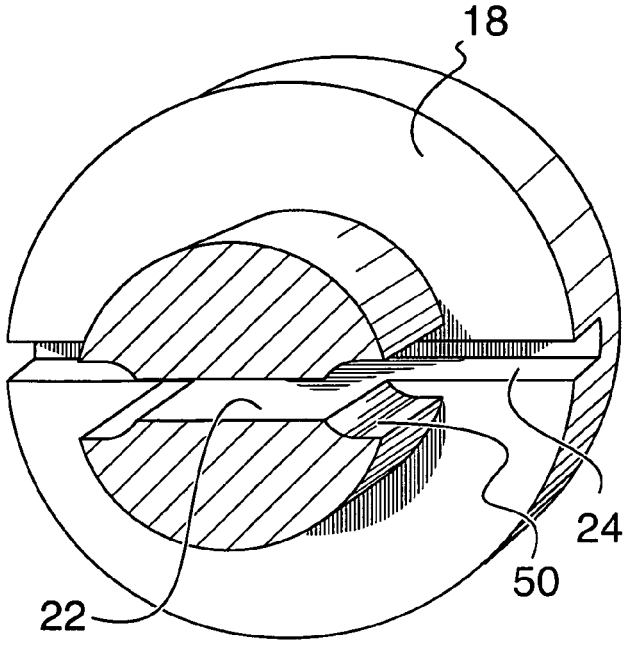
FIG. 6 is a perspective view, in section, of the rotor and end disk of the pump of FIG. 1.

Different configurations of vanes 26 in accordance with the invention are illustrated in FIGS. 3, 4 and 5. While the enlarged head vane of FIG. 5 has been described previously herein, the vanes 26 of FIGS. 3 and 4 are constructed so as to provide an outward, spring induced bias to supplement the outward centrifugal force acting on the vanes during operation of the pump. In particular, each vane 26 cooperates with a shoe plate 54 at its lower edge 44, the shoe plate being provided with spring loaded pins 56 (FIG. 3) or a spring loaded plate 58 (FIG. 4), these pins and plates slidably movable within corresponding apertures in the lower edge 44 of the corresponding vane 26. The pins and plates also further assist in guiding the vanes in their reciprocating movement within vane slot 22.

A removable panel 60 may be provided in housing 4 to provide servicing access to chamber 10 and the pump components within chamber 10.

In operation, as can be seen in FIGS. 1*a*, 1*b* and 1*c*, as rotor 16 is driven in clockwise fashion, centrifugal force (in combination with the outward spring urged bias on vanes 26, if the vane embodiment of FIG. 3 or 4 is used) ensures that the upper edges 42 of vanes 26 constantly bear against the relevant first, second and third portions 28, 30 and 34 respectively, of side wall 12 of housing 4. The inlet and outlet ports 6 and 8 are on opposite sides of midpoint 32. Side wall 20 of rotor 16 is in contact with side wall 12 of housing 4, at midpoint 32, ensuring that fluid from inlet port 4 does not escape directly to outlet port 8. Instead, fluid from inlet port 6 is drawn into chamber 62 (FIG. 1*a*) as one of the vanes 26 passes over inlet port 6 and progresses to first portion 28 of side wall 12 of housing 4. Side wall 12 at all times acts as a cam surface on upper edges 42 of the vanes 26. As the rotor 16 continues in clockwise fashion, the other vane 26 passes over inlet port 6. Chamber 62 then becomes sealed off and is at maximum volume (FIG. 1*a*). With further clockwise movement of rotor 16, as the first vane 26 passes outlet port 8 (FIG. 1*b*), that chamber 62 then communicates with outlet port 8 and, as the volume of chamber 62 decreases with further clockwise movement of rotor 16 (with the decreasing distance of second portion 30 of side wall 12 of housing 4 with respect to the surface of side wall 20 of rotor 16), fluid is forced with the diminishing volume of that chamber 62 through outlet port 8.

Fluid which enters vane slot 22 is not permitted to build up there as it is passed back to the surface of rotor 16 through check valves 38 in vent slots 36.

Because of the relatively simple construction of the pump according to the present invention, with only two vanes and few moving parts, a pump which is inexpensive to construct and easy to repair is provided. The construction of the pump according to the present invention permits high torque on the rotor and high volume fluid movement since the shaft which drives the rotor can be the same diameter as that of the rotor.

The pump of the present invention is particularly suited to waste water, well water, hydraulics and other applications. If solids are entrapped in fluid being pumped, and get into interior chamber 10, the enlarged heads 48 of vanes 26 will tend to crush the solids to smaller sizes so that those solids will pass through the pump 2.

The pump according to the present invention withstands high pressure, since the shoulders 46 of the vanes 26 are supported by the end disks 18. The simple construction of the pump according to the present invention permits it to be easily serviced and repaired in the field.

Thus, it is apparent that there has been provided in accordance with the invention a rotary piston device that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A positive displacement pump for fluids comprising:

(a) a housing, the housing defining a chamber having opposed, interior end walls and an interior side wall extending therebetween;

(b) a fluid inlet and a fluid outlet port located at spaced locations in the side wall;

(c) a rotor, to rotate about a longitudinal axis extending through the end walls, mounted within the housing chamber, the rotor having ends and a cylindrical side wall confronting respectively the interior end walls and side wall of the chamber;

(d) a rotor disk at each end of the rotor secured to the rotor, the diameter of the end disks being greater than the diameter of the rotor;

(e) a slot extending diametrically completely through the rotor, longitudinally between the rotor ends, the slot having openings in opposite portions of the rotor side wall;

(f) a pair of similar, planar vanes, one vane slidably mounted in one opening of this slot and the other mounted in the other opening of the slot, each vane extending from end to end in the rotor and having inner and outer edges extending parallel to the axis rotation of the rotor, each vane mounted so as to slide within the slot between an extended position protruding upwardly from a surface of the rotor side wall and a retracted position wherein the vane is entirely withdrawn into the rotor below that surface, each vane being provided with opposite shoulders at their sides, which shoulders slide in corresponding slots in the rotor disks;

(g) a first portion of the interior side wall of the housing being cylindrical and curved with constant radius over an angle of approximately 180°, this portion being spaced a constant distance from corresponding portions of the side wall of the rotor, a second portion of the interior side wall of the housing, in the vicinity of the outlet port, extending from an extremity of said first portion to a midpoint beyond said outlet port intermediate between said outlet port and said inlet port, the distance between said second portion and the side wall of the rotor progressively decreasing until it is immediately adjacent that side wall at said midpoint, and a third portion of the interior side wall of the housing, in the vicinity of the inlet port, extending from said midpoint to the other extremity of the first portion of the interior end wall, in the vicinity of the inlet port, the distance between said third portion and the side wall of the rotor progressively increasing between said midpoint and said other extremity of said first portion;

the rotor, housing and vanes constructed so that, during operation of the pump, fluid entering the housing through the inlet port is carried by the rotor in compartments formed between the vanes, the rotor side wall between those vanes, the rotor disks and the interior side wall of the housing, until the compartments communicate with the outlet port, whereby the fluid is moved from the chamber through the outlet port, the vanes, during this operation, being urged outwardly so that their outer edges are in constant contact with the interior side wall of the housing and being urged inwardly by said housing side wall acting as a cam surface on said outer edges.

2. A pump according to claim 1, wherein the outer edges of the vanes are enlarged to form heads which provide additional weight to the vanes, whereby the vanes' outward movement is caused by centrifugal force during operation of the pump, the opening of the slot, on each side of the rotor, being enlarged to receive the enlarged head of the corresponding vane when the vane is in retracted position.

3. A pump according to claim 2, wherein a resilient material is provided in the enlarged openings of the slots to provide sealing and shock absorbing functions during movement of the vanes.

4. A pump according to claim 1, wherein a vent slot extends diametrically through the rotor at an angle to the vane-carrying slot, and communicates therewith, and a pair of check valves are located in the vent slot to permit outward, but not inward, passage of fluid with respect to said vent slot.

5. A pump according to claim 4, wherein the vent slot is oriented at a 90° angle to the vane carrying slot.

6. A pump according to claim 1, wherein a portion of the housing in said first portion of the inner wall is constructed so as to be removable to permit access to the rotor and vanes within the housing chamber.

7. A pump according to claim 1, wherein biasing means are provided between the inner edges of the vanes within the vane slot to provide outward biasing of the vanes during operation of the device and to ensure constant contact of the outer edges of the vanes with the inner side wall of the housing.

8. A pump according to claim 7, wherein spring loaded guides are slidably mounted within pockets in the lower edges of the vanes, the guides from each vane being in constant contact with each other during operation of the pump.

* * * * *